US006484962B2

(12) United States Patent
Lassmann

(10) Patent No.: US 6,484,962 B2
(45) Date of Patent: Nov. 26, 2002

(54) METHOD FOR GRADUATED PRECISION WINDING OF A TEXTILE YARN CHEESE

(75) Inventor: Manfred Lassmann, Nettetal (DE)

(73) Assignee: W. Schlafhorst AG & Co. (DE)

( * ) Notice: Subject to any disclaimer, the term of this patent is extended or adjusted under 35 U.S.C. 154(b) by 61 days.

(21) Appl. No.: 09/822,170

(22) Filed: Mar. 30, 2001

(65) Prior Publication Data

US 2002/0040946 A1 Apr. 11, 2002

(30) Foreign Application Priority Data

Mar. 30, 2000 (DE) ..... 100 15 933

(51) Int. Cl.[7] ..... B65H 54/32
(52) U.S. Cl. ..... 242/478.1; 242/477.5
(58) Field of Search ..... 242/477.6, 477.5, 242/478.1

(56) References Cited

U.S. PATENT DOCUMENTS

| | | | | | |
|---|---|---|---|---|---|
| 4,667,889 | A | * | 5/1987 | Gerhartz | 242/477.6 |
| 4,697,753 | A | * | 10/1987 | Schippers et al. | 242/477.6 |
| 5,447,277 | A | * | 9/1995 | Schluter et al. | 242/477.6 |
| 5,605,295 | A | | 2/1997 | Klee | 242/18.1 |
| 6,027,060 | A | * | 2/2000 | Siepmann | 242/447.1 |
| 6,311,920 | B1 | * | 11/2001 | Jennings et al. | 242/477.6 |

FOREIGN PATENT DOCUMENTS

| | | |
|---|---|---|
| DE | 40 37 278 A1 | 5/1992 |
| DE | 41 12 768 A1 | 10/1992 |
| DE | 42 23 271 C1 | 6/1993 |
| DE | 196 26 962 A1 | 2/1997 |
| EP | 0 055 849 A2 | 7/1982 |
| JP | 4-365755 | 12/1992 |

OTHER PUBLICATIONS

German Search Report.

* cited by examiner

*Primary Examiner*—Michael R. Mansen
*Assistant Examiner*—Minh-Chau Pham
(74) *Attorney, Agent, or Firm*—Kennedy Covington Lobdell & Hickman, LLP

(57) ABSTRACT

A method for producing graduated precision windings on cheeses in an open-end spinning system. The winding ratio is reduced in stages, in increasingly smaller graduations, as the cheese diameter increases during the bobbin travel of the cheese. The graduations do not exceed the value of 0.3 and are each selected such that changes in the crossing angle are within a tolerance range of less than ±0.8°, and the least number of diamonds occurring during the building of the bobbin can be completely filled. The cheeses thusly produced are distinguished by a stable construction, high density with uniform distribution of density over the entire yarn package, and excellent payout properties.

10 Claims, 4 Drawing Sheets

METHOD FOR GRADUATED PRECISION WINDING OF A TEXTILE YARN CHEESE

CROSS-REFERENCES TO RELATED APPLICATIONS

This application claims the benefit of German patent application 10015933.8 filed Mar. 30, 2000, herein incorporated by reference.

FIELD OF THE INVENTION

The present invention relates to a method for the stepwise precision winding of yarn into the form of a package commonly referred to as a cheese. More particularly, the present invention relates to such a method wherein a staple fiber yarn is fed at a constant yarn speed from a feeder mechanism of an open-end spinning system to a winding apparatus which rotates the cheese at a constant circumferential winding speed and, over the course of the progressive building of the cheese by the winding operation, the winding ratio is reduced in stages by graduations of decreasing size as the cheese diameter increases.

BACKGROUND OF THE INVENTION

When a cross-wound bobbin, also known as a cheese, is produced with a random winding, the speed of yarn traversing and the circumferential speed of the cheese over the course of building the bobbin, i.e., from the beginning to the end of the winding process, are in a fixed ratio to one another. As a result, the yarn crossing angle remains constant, while the winding ratio decreases as the bobbin diameter increases. The winding ratio indicates the number of bobbin revolutions per double yarn traversing stroke. A cheese produced with random winding has a stable yarn package and a largely uniform density. For instance, when integral values of the winding ratio are followed, so-called winding ribbons or mirror windings occur. To avoid their disadvantageous consequences, so-called ribbon breaking methods are employed, but such methods do not break up the ribbons completely.

The term "cheese" used here also applies to the bobbin package that builds up during the winding of the cheese. In producing a cheese with precision winding, it is not the yarn crossing angle but the winding ratio that is kept constant over the entire bobbin travel. The yarn crossing angle decreases as the cheese diameter increases. As the crossing angle decreases, the winding density increases outwardly. As a result, the pressure on the relatively soft bobbin core accordingly increases to an undesirable and disadvantageous extent. Problems can result in unwinding the cheese resulting from uneven yarn tension and increasingly frequent yarn breakage as well as uneven penetration of dye through the yarn package. In principle, the advantages of precision winding reside in the possibility of a high payout speed, high package density, and thus greater running length for the same bobbin volume, compared to a cheese with random winding. However, as the cheese diameter increases, the decreasing crossing angle limits the diameter in the production of precision bobbins made of staple fiber yarns due to the defects that occur at the package edges since staple fiber yarns in particular cannot be wound with arbitrarily small crossing angles. For this reason, in open- end spinning, crossing angles of less than 28 degrees should be avoided. As a result, precision winding with staple fiber yarns can be used only with severe limitations.

Graduated precision winding represents a combination of random winding and precision winding, in which the advantages of both types of winding are intended to be achieved and the disadvantages are intended to be decreased. Along with random winding and precision winding, graduated precision winding is a conventional term in textile technology, which is discussed at length for example in German Patent DE 42 23 271 C1 and German Patent Disclosure DE 39 20 374.

In graduated precision winding, as the term already expresses, a precision winding is produced in stages or steps. For example, a maximum permissible crossing angle is set and, as each stage progresses, the crossing angle gradually becomes smaller while the winding ratio remains constant. Once the crossing angle reaches the smallest permissible value, the crossing angle is abruptly restored to the initial value. The winding ratio thus drops to a smaller value. As a result, a cheese with a virtually constant crossing angle is obtained in which the winding ratio has been reduced in stages.

With graduated precision winding produced in this manner, however, the above-described density problems and problems of stability of the bobbin edge are merely lessened. Along with the density problems with the above-described causes and an increasing pressure on the internal yarn layers, still another problem arises. With the reduction in the crossing angle, the wound length per unit of time also drops. This is especially disadvantageous in open-end spinning machines. Since the yarn produced on open-end spinning machines is always fed at a constant yarn speed, the yarn tension between the cheese and the draw-off rolls, for instance, is reduced by the decreasing windup length per unit of time. By the time the cheese has been nearly fully wound, there can be differences in the tension distortion of about 3.5%. This leads to marked differences in density and impairs the reeling-off (i.e., unwinding) properties of the cheese considerably. Depending on the graduation in the graduated precision winding, it can happen that the winding ratio or winding number will randomly drop to one of the aforementioned mirror values or to the critical vicinity of such a value.

From the extensive prior art mentioned above, which addresses the problems that occur in graduated precision winding, several selected references warrant comment. In German Patent 42 23 271 C1, a method for winding a yarn by means of graduated precision winding is described, in which the traversing frequency is increased abruptly within a range that is determined by a minimum winding angle and a maximum lay angle. The traversing frequency is decreased within a stage from an initial frequency to a final frequency in proportion to the bobbin speed (rpm) and is then increased abruptly to the initial frequency of the next stage. This initial frequency in each stage is at most equal to a fixed maximum frequency. The final frequency in each stage is at least equal to a fixed minimum frequency. Because winding is performed in all stages with winding numbers near a mirroring value, the intent is to provide the bobbin with a uniformly high packing density.

In German Patent Disclosure DE 41 12 768 A1, a method for producing stepwise precision winding is described, in which the switchover to the next winding stage in each case takes place when a diameter value stored in memory is reached. The intent is for instance not to have to input certain individual yarn-specific parameters of the yarn to be wound into the computer, or to make additional measurements. According to this reference, the procedure for producing graduated precision windings is expediently accomplished by selecting a crossing angle $\alpha$, or a crossing angle tolerance range $\alpha 1$ to $\alpha 2$, on the basis of which characteristic variables of the winding stages are calculated. In this German Patent Disclosure DE 41 12 768 A1, it is recommended that the method be performed such that the tolerance range α1 to α2 of the selected crossing angle a is between ±4°.

Along with the above-described method in which the beginning of a new stage is initiated when the values of predetermined threshold crossing angles are exceeded, it is also possible to designate graduations in respect to the winding ratio, for example as a function of threshold values formed of cheese diameters. The graduations in the winding ratio can then be of constant size, for instance.

European Patent Disclosure EP 0 055 849 B1, which defines the basic type of graduated precision winding method to which the present invention relates, defines a method for graduated precision winding of yarns by means of a winding apparatus wherein the yarns are delivered continuously at constant speed. This method seeks to avert excessive differences in the winding speed, and the disadvantageous effects of such differences on the quality of the yarns and on the bobbin construction, by keeping the change in the winding ratio from one stage of the precision winding to the next so slight that the attendant change in winding speed of the yarn does not exceed a tolerance range above and below the value of the mean winding speed. However, irregularities in the bobbin structure occur in the range of small bobbin diameters, especially irregularities at the bobbin edges, are not prevented by the method disclosed in this European Patent Disclosure EP 0 055 849 B1.

With the known prior art discussed above, the problems in producing cheeses by means of graduated precision winding are overcome only inadequately, if at all, especially in open-end spinning machines, even though the engineering and control work related to such systems is at considerable industrial effort and expense.

OBJECT AND SUMMARY OF THE INVENTION

It is accordingly an object of the present invention to provide an improved method for producing graduated precision windings, especially for but not limited to use on open-end spinning machines to produce coarse yarns.

This object is addressed by a method, preferably adapted for but not limited to use in an open-end spinning system, for graduated precision winding of a staple fiber yarn fed at a constant yarn speed onto a cheese or like package rotating at constant circumferential speed. In accordance with the present invention, the winding ratio during progressive building of the cheese is reduced in stages by graduations of decreasing size as the diameter of the cheese increases. Each such graduation decreases the winding ratio by a value not exceeding 0.3, with each such graduation being selected to be sufficiently small to produce a change in a crossing angle of the yarn during winding of between about ±0.8° of a predetermined set-point value for the crossing angle and selected to be sufficiently large to completely fill a smallest number of yarn winding diamonds occurring in the respective yarn winding stage.

By employing a staged reduction of the winding ratio during building of the cheese utilizing increasingly smaller graduations as the cheese diameter increases, the method according to the present invention overcomes deleterious problems in bobbin construction that in the prior art are not overcome by merely and simply reducing the size of the graduations The prevailing winding ratio, $WD_{akt}$, is calculated continuously from the then-current cheese diameter $d_{SPakt}$, the set-point crossing angle $\alpha_{SOLL}$, and the double stroke length of the winding traverse DH, and the calculated winding ratio is compared continuously with a winding ratio $WD_{n+1}$ that is predetermined for the applicable stage.

For calculating the current winding ratio $WD_{akt}$, the following formula applies:

$$WD_{akt} = \frac{DH}{d_{SPakt} * \cdot \pi * \tan(\alpha_{SOLL}/2)}$$

The cheese diameter $D_{SP}$ is calculated in friction driving of the bobbin via the speed (rpm) $n_w$ of the friction drive shaft, the known diameter $d_w$ of this shaft, and the bobbin rpm $n_{SP}$:

$$D_{SP} = \frac{n_w \cdot d_w}{n_{sp}}$$

A new winding ratio $WD_{n+1}$ for the next succeeding stage is calculated and predetermined. A change into the next stage is made whenever a calculation operation shows that the current calculated winding ratio $WD_{akt}$ is equal or already smaller than the predetermined winding ratio $WD_{n+1}$. For instance, with the goal of obtaining a more-uniform bobbin construction in the open-end spinning process, if a graduation in the applicable predetermined winding ratio $WD_{n+1}$ is selected, in which ratio successive decreasing values of the winding ratio $WD_{n+1}$ each differ by the very slight value 0.1, as represented by the formula $$WD_{n+1} = WD_n - 0.1,$$

then the course 22 of the predetermined winding ratio $WD_{n+1}$ as shown in FIG. 2 is obtained. A disadvantage of a cheese wound in this manner, however, is a marked increase in the range of fluctuation in the deviation from the set-point crossing angle $\alpha_{SOLL}$. Such angle deviations, above a cheese diameter of about 100 mm, already cause markedly visible bumps on the cheese at the bobbin flank despite the fact that the graduations in the predetermined winding ratio are kept quite slight.

This disadvantage can be overcome by the method according to the invention. The need to reduce the graduation in the winding ratio markedly still further with a view to eliminating the development of undesired bumps, or reducing it to a tolerable amount, can also be avoided. But even further-reduced graduations in the winding ratio, in the cheese diameter range below 100 mm, are then disadvantageously so close together that a change to a new winding ratio will occur even upon an increase of less than 1 mm in the cheese diameter. However, the winding-ratio-specific yarn laying pattern is usually not yet concluded by such time. Not until the next winding ratio $WD_{n+1}$ with a different laying pattern or a different number of diamonds are the voids located beneath covered, but not closed, while at the same time new ones are allowed to form in a different arrangement. These voids necessarily lead to losses in density and to a "soft" bobbin core. As the cheese diameter increases, the pressure on this soft core also increases. This can be so extensive that so-called bloomings and loose edges arise. In such cheeses, it is not necessarily assured that the yarns can be reeled off (i.e., unwound) without breaking. These disadvantages are avoidable, however, with the method according to the invention.

Each graduation is preferably selected by calculating each successive winding ratio $WD_{n+1}$, by subtracting an amount from the then-prevailing winding ratio (either the initial winding ration when determining the first graduation or a succeeding winding ratio $WD_n$ for a subsequent winding stage) which amount is calculated by multiplying the integral component $G_{WD}$ of the applicable winding ratio $WD_n$ by a graduation factor $F_{ST}$. For this calculation, the following formula applies:

$$WD_{n+1}=WD_n-(F_{ST}^{*}\ G_{WD}).$$

Advantageously, the graduation factor is no greater than 0.05, and in particular is preferably between 0.02 and 0.05, in order to obtain graduations in the winding ratio with the desired effect.

In an alternative version of the method of the invention, the calculation of the applicable winding ratios or the applicable graduations in the winding ratio can also be done on the basis of a percentage wise graduation in the cheese diameter. In this embodiment, each successive winding ratio $WD_{n+1}$, is calculated in accordance with the formula $$D_{n+1}=D_{akt}+D_{akt}\cdot F_D$$

Wherein the initial or subsequently prevailing current cheese diameter $D_{SPakt}$ is multiplied by a percentage factor $f_D$; this product is added to the initial or current cheese diameter $D_{SPakt}$, and the value of the cheese diameter $D_{SPn+1}$ thus obtained is converted into a corresponding value to which the winding ratio $WD_{n+1}$ is to be set. The conversion is done by the following formula:

$$WD_{n+1}=\frac{DH}{D_{SPn+1}*\pi*\tan\alpha 1/2}$$

In a preferred feature of the method of the invention, the graduation in the core area or region of the cheese is increased, preferably in the first segment of the bobbin travel, by means of an additional multiplier.

In a further advantageous version of the method of the invention, each winding ratio is ascertained by adding to or subtracting from the winding ratio a supplemental step-up ratio derived from the quotient of the yarn spacing and the number of diamonds in the current winding ratio by a calculation which incorporates these parameters into the determination of this step-up ratio. Thus the yarn winding diamonds can be closed or filled completely, and very uniform winding of the cheese can be attained. The number of yarn winding diamonds is also known as the order number. The calculation of the supplemental step-up $i_z$ of the winding ratio is accomplished according to the formula:

$$i_z=\frac{s}{n_R*D_{SP}*\pi*\sin(\alpha/2)}$$

wherein, $i_z$=supplemental step-up of the winding ratio s=yarn spacing $D_{SP}$=cheese diameter $\alpha$=set-point crossing angle $n_R$=number of diamonds The yarn spacing s is preselected by the user in a manner known per se as a function of the material comprising the yarn and then is ascertained empirically. The number of diamonds $n_R$ can also be calculated in a manner known per se or can for instance be taken from a table.

The graduation is advantageously selected such that winding ratios with which a desired, known number of diamonds can be associated are always obtained. For example, it can thus be assured that the number of diamonds is no greater than 50, and by the choice of such a value that is not overly large for the number of diamonds, excessively small yarn spacings are counteracted. The incidence of an arbitrarily high number of diamonds, which undesirably limits the possibilities of intervention in cheese construction using the supplemental step-up of the winding ratio, is averted.

The method of the present invention for producing a graduated precision winding represents an easily executed and inexpensive method that also produces satisfactory results on open-end spinning machines. The bobbins made by this method are distinguished by uniformly high density, smooth flanks without bumps and without bloomings at the bobbin edges in the region of the bobbin core, as well as very good payout properties. The engineering outlay can be kept low. There is no need for a separately driven winding roller or a sensor system for monitoring winding tension. In particular, the average winding quantity of the cheeses produced changes only slightly. The absolute error in the tension distortion when the method of the present invention is employed is rarely more than 0.1%. A further advantage of the method of the present invention is that simple calculation, over the entire bobbin construction, of the next successive winding ratio is possible on the basis of predetermined data such as D, DH, WD and $\alpha$, with a single, fixed multiplier for the graduations of the winding ratio.

The invention will be described in further detail below in conjunction with the accompanying drawings.

DESCRIPTION OF THE PREFERRED EMBODIMENTS

Figure 1:
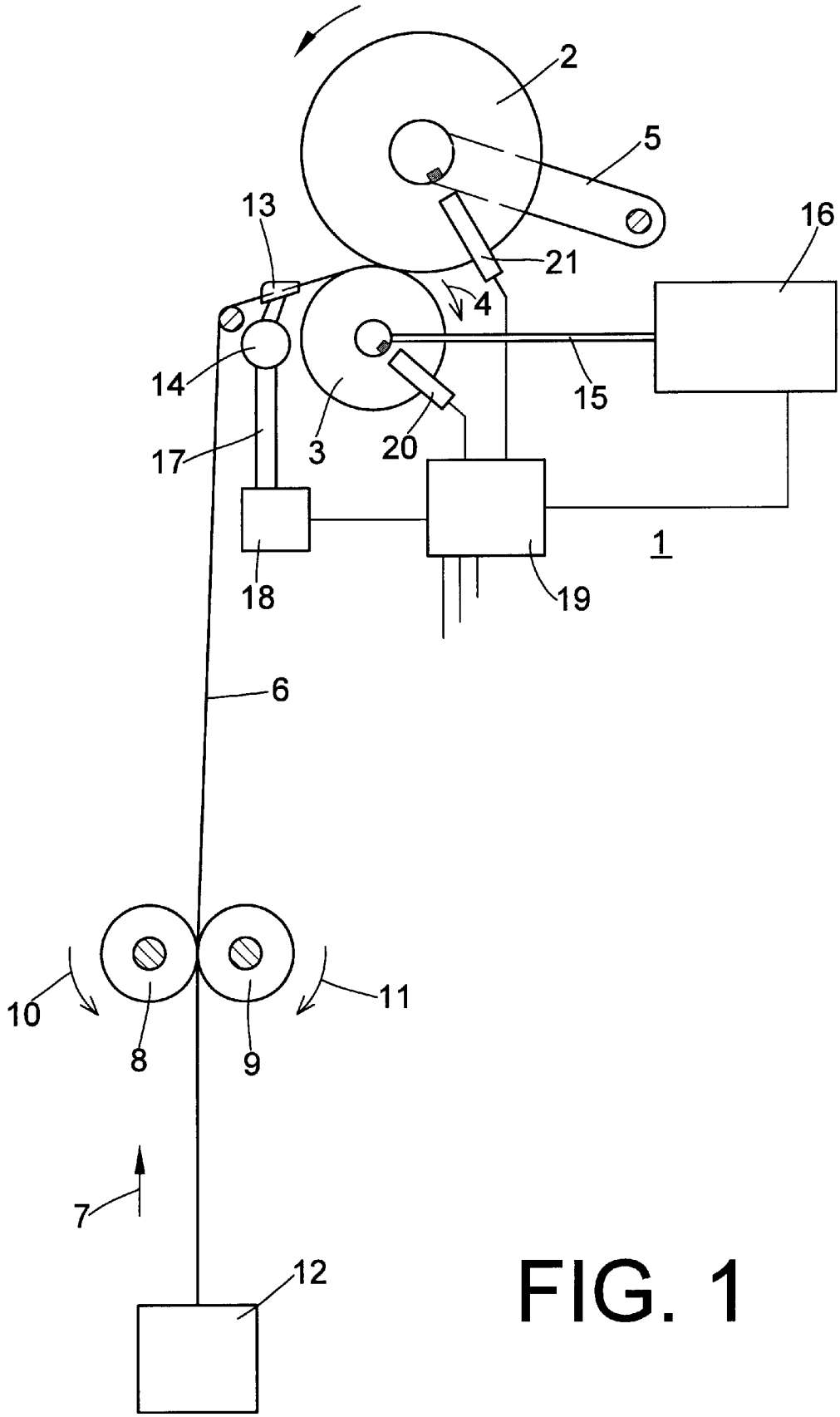
FIG. 1 is a simplified, schematic view of an apparatus for performing the method according to the present invention.

FIG. 1 shows a winding system 1 of an open-end spinning system that produces cross-wound bobbins, also known as cheeses. The winding system 1 has a friction roller 3, which rotates in the direction of the arrow 4, for driving the cheese 2. The cheese 2 is retained by means of a pivotable creel 5 and rests on the friction roller 3. The yarn 6 is drawn off at a constant yarn speed in the direction of the arrow 7 from a feeder mechanism 12 of the open-end spinning apparatus, e.g., embodied as a spinning box, by means of a pair of draw-off rollers 8, 9, which rotate in the direction of the arrows 10, 11. The yarn 6 is wound onto the cheese 2 via a traversing yarn guide 13. The yarn guide 13 is driven by means of a traversing device 14. The friction roller 3 is driven via a shaft 15 by means of a motor 16. The traversing device 14 is connected via an operative connection 17 to a motor 18. Both the motor 16 and the motor 18 are controlled by a microprocessor 19, which is embodied to include a program for controlling the winding ratio as a function of the currently prevailing cheese diameter. The current cheese diameter is calculated from the yarn length that has been wound onto the cheese 2. The yarn length is ascertained with the aid of a sensor 20, which detects the revolutions of the friction roller 3. A further sensor 21 is provided for detecting the speed (rpm) of the cheese 2, which like the sensor 20 is connected to the microprocessor 19.

In a first exemplary embodiment of the method, the calculation of a new winding ratio $WD_{n+1}$ to accomplish a graduation of the then prevailing winding ratio will be described. This method begins with an initial winding ratio $WD_0$; for purposes of this description and by way of example only the initial winding ratio is assumed to be $WD_0=6$. Further values for the exemplary embodiment are:

$\alpha=30°$

DH=294 mm

The cheese diameter $D_{SP}$ is calculated continuously in accordance with the formula:

$$D_{SP} = \frac{n_{FW} x D_{FW}}{n_{SP}}$$

In this formula, $n_{FW}$=rpm of the friction roller $D_{FW}$=diameter of the friction roller $n_{SP}$=rpm of the cheese The currently prevailing winding ratio $WD_{akt}$ is calculated continuously by the following formula:

$$WD_{akt} = \frac{DH}{D_{akt} * \pi * \tan\alpha/2}$$

The current winding ratio $WD_{akt}$ is compared continuously with the next winding ratio $WD_{n+1}$ that is to succeed the particular prevailing winding stage. Since the cheese diameter $D_{SPakt}$ increases continuously, the current winding ratio $WD_{akt}$ correspondingly becomes constantly smaller. Once $$WD_{akt} \leqq WD_{n+1}$$

is attained, a new winding ratio $WD_{n+2}$ is calculated, by the following formula:

$$WD_{n+2}=WD_{n+1}-F_{ST}\times G_{WD}$$

wherein $F_{ST}$=factor for the graduation of the winding ratio WD $G_{WD}$=integral component of $WD_{akt}$.

For the first exemplary embodiment of the method, $F_{ST}$= 0.025.

Thus, beginning with an initial winding ratio $WD_0=6$, the value for the next winding ratio $WD_1$ is calculated as follows:

$$WD_1=6-(0.025\times 6)=6-0.15=5.85.$$

With the values for this exemplary embodiment, WD is obtained by the formula $$WD = \frac{294}{D_{akt} * \pi * \tan 15°}$$

At a cheese diameter $D_0$, the winding ratio $WD_0=6$. If the result of the continuous calculation of the winding ratio WD is $$WD \leqq WD_1=5.85,$$

then for the next graduation, the winding ratio $WD_2$ is calculated:

$$WD_2=5.85-(0.025\times 5.000)=5.85-0.125=5.725.$$

Figure 2:
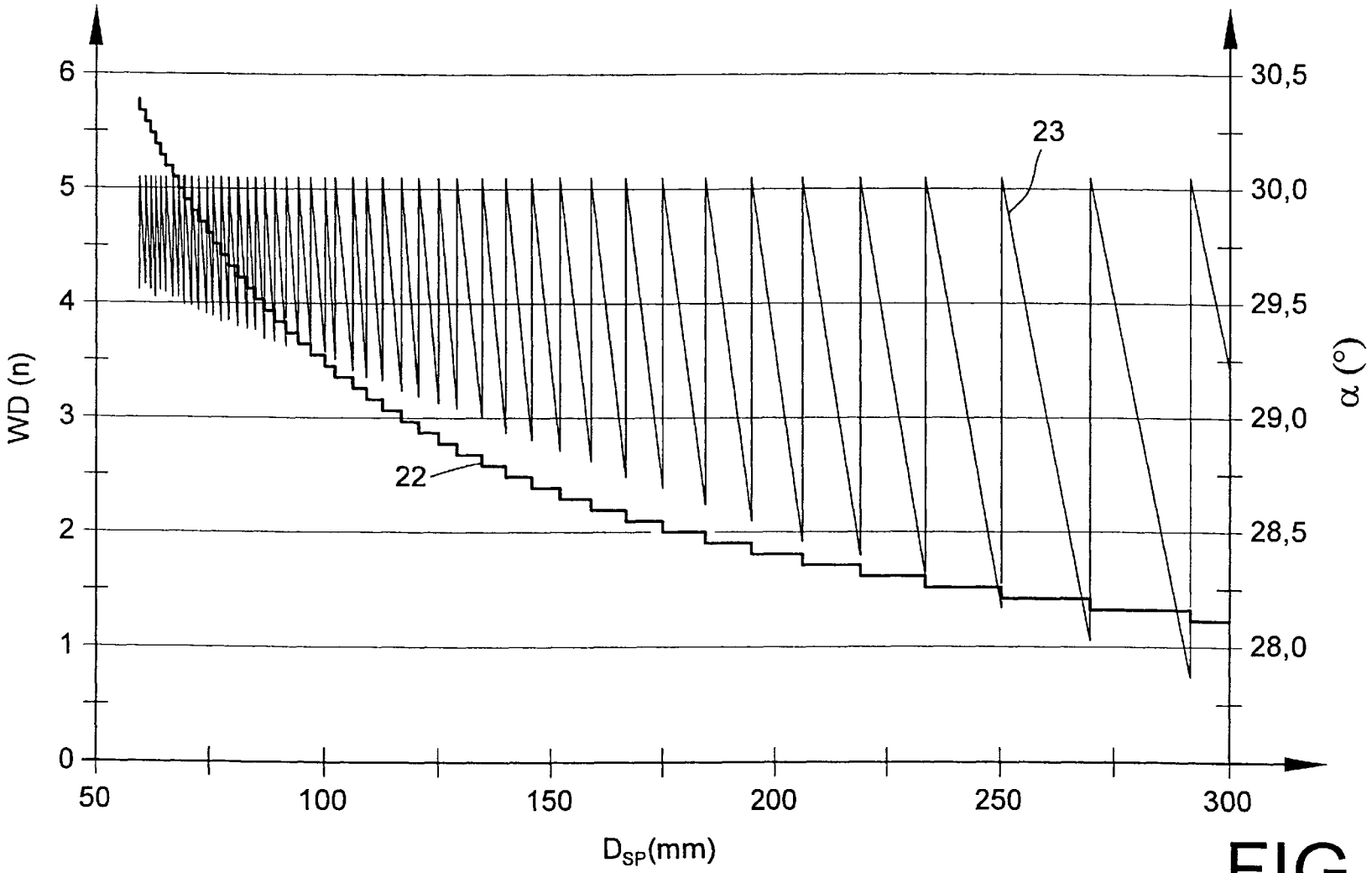
FIG. 2 PRIOR ART
FIG. 2 depicts the progressive changes in the winding ratio and yarn crossing angle in a winding operation wherein the winding ratio graduation is a constant 0.1.
Figure 3:
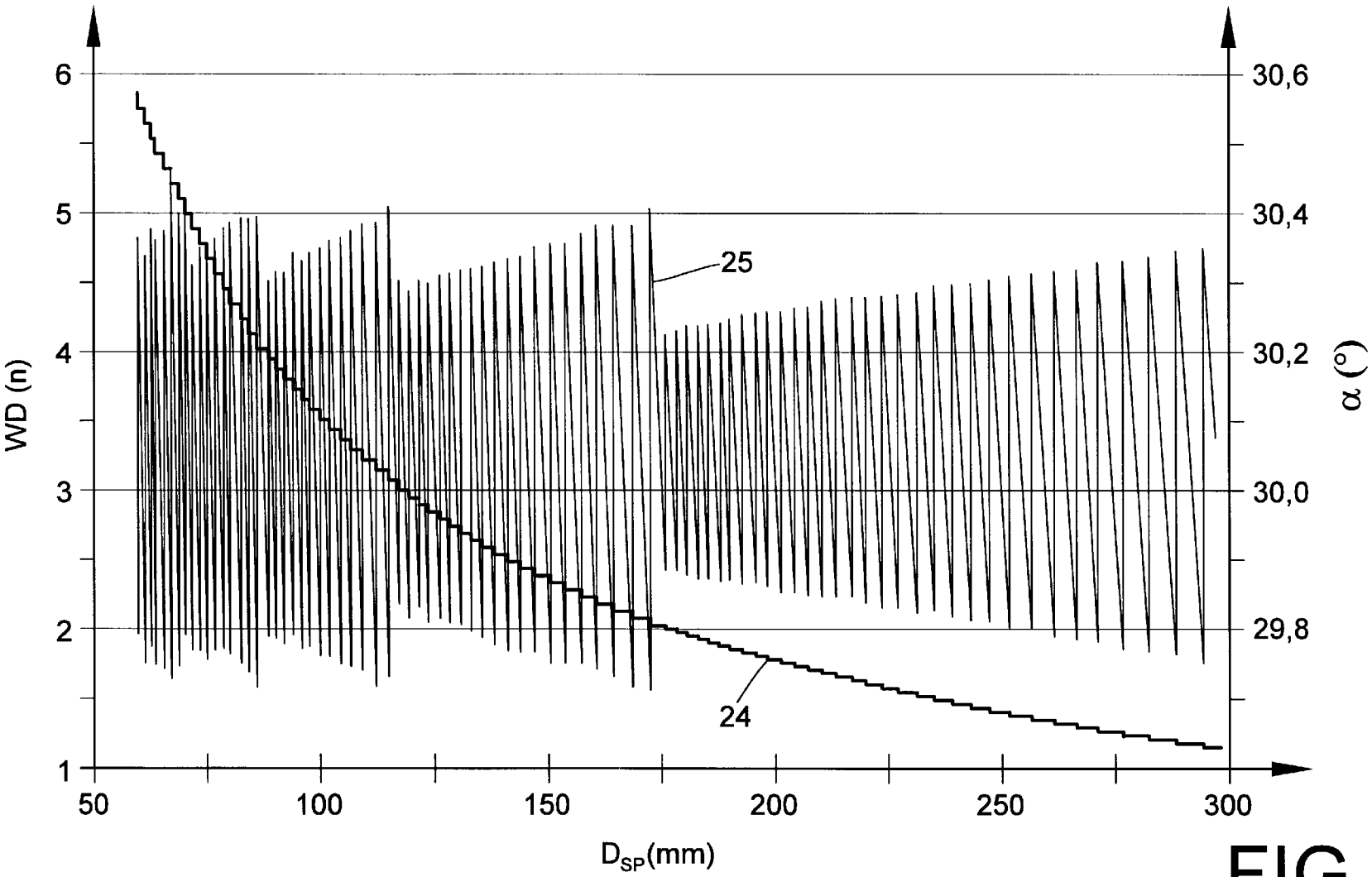
FIG. 3 depicts the progressive changes in the winding ratio and yarn crossing angle in a winding operation according to the present invention.

FIG. 3 is a graph depicting a curve representing the progressing course 24 of the winding ratio WD, plotted over the cheese diameter D. As FIG. 3 shows, the range within which the crossing angle $\alpha$, indicated at 25, varies during performance of the method of the present invention is considerably narrower than the fluctuation range shown in FIG. 2 for the crossing angle $\alpha$, therein indicated at 23.

In a corresponding manner, the successive winding ratios WD and cheese diameters D are formed, resulting in the values shown in Table 1.

TABLE 1

| WD Winding Ratio | D[mm] Bobbin Diameter | WD Winding Ratio | D[mm] Bobbin Diameter |
|---|---|---|---|
| 6.000 | 58.21 | 2.275 | 153.52 |
| 5.850 | 59.70 | 2.225 | 156.97 |
| 5.725 | 61.01 | 2.175 | 160.58 |
| 5.600 | 62.37 | 2.125 | 164.36 |
| 5.475 | 63.79 | 2.075 | 168.32 |
| 5.350 | 65.28 | 2.025 | 172.47 |
| 5.225 | 66.84 | 1.975 | 176.84 |
| 5.100 | 68.48 | 1.950 | 179.11 |
| 4.975 | 70.20 | 1.925 | 181.43 |
| 4.875 | 71.64 | 1.900 | 183.82 |
| 4.775 | 73.14 | 1.875 | 186.27 |
| 4.675 | 74.71 | 1.850 | 188.79 |
| 4.575 | 76.34 | 1.825 | 191.37 |
| 4.475 | 78.05 | 1.800 | 194.03 |
| 4.375 | 79.83 | 1.775 | 196.76 |
| 4.275 | 81.70 | 1.750 | 199.58 |
| 4.175 | 83.65 | 1.725 | 202.47 |
| 4.075 | 85.71 | 1.700 | 205.45 |
| 3.975 | 87.86 | 1.675 | 208.51 |
| 3.900 | 89.55 | 1.650 | 211.67 |
| 3.825 | 91.31 | 1.625 | 214.93 |
| 3.750 | 93.14 | 1.600 | 218.29 |
| 3.675 | 95.04 | 1.575 | 221.75 |
| 3.600 | 97.02 | 1.550 | 225.33 |
| 3.525 | 99.08 | 1.525 | 229.02 |
| 3.450 | 101.23 | 1.500 | 232.84 |
| 3.375 | 103.48 | 1.475 | 236.78 |
| 3.300 | 105.84 | 1.450 | 240.87 |
| 3.225 | 108.30 | 1.425 | 245.09 |
| 3.150 | 110.88 | 1.400 | 249.47 |
| 3.075 | 113.58 | 1.375 | 254.01 |
| 3.000 | 116.42 | 1.350 | 258.71 |
| 2.925 | 119.40 | 1.325 | 263.59 |
| 2.875 | 121.48 | 1.300 | 268.66 |
| 2.825 | 123.63 | 1.275 | 273.93 |
| 2.775 | 125.86 | 1.250 | 279.41 |
| 2.725 | 128.17 | 1.225 | 285.11 |
| 2.675 | 130.56 | 1.200 | 291.05 |
| 2.625 | 133.05 | 1.175 | 297.24 |
| 2.575 | 135.63 | 1.150 | 303.70 |
| 2.525 | 138.32 | 1.125 | 310.45 |
| 2.475 | 141.11 | 1.100 | 317.51 |
| 2.425 | 144.02 | 1.075 | 324.89 |
| 2.375 | 147.06 | 1.050 | 332.63 |
| 2.325 | 150.22 | 1.025 | 340.74 |

In an alternative variant of the method of the present invention, the calculation of the applicable winding ratios at which an abrupt increase in the winding ratio occurs because of an abrupt increase in the traversing frequency of the yarn guide, can also be performed on the basis of a percentagebased diameter graduation. For this embodiment of the present method, the following formula applies:

$$D_{n+1}=D_n+(D_n \times F_D).$$

The applicable cheese diameter $D_n$ is multiplied by the factor $F_D$, and the value obtained is added to $D_n$. Next, $D_{n+1}$ is converted into the corresponding value of the winding ratio $WD_{n+1}$, to which the winding ratio is to be set in the next stage. The current cheese diameter $D_{akt}$ at the time is ascertained continuously by the formula already mentioned above:

$$D_{akt}=n_{FW} \times d_{FW}/n_{SP}$$

For sake of illustrating and explaining this alternative variant of the method of the present invention, the following values may be assumed to apply as examples:

$F_D$=0.019

α=30°

DH=294 mm $D_0$=60 mm

The corresponding winding ratio $WD_0$ is calculated as follows:

$$WD_0 = \frac{DH}{D_0 * \pi * \tan(\alpha_{SOLL}/2)} = \frac{294}{60 * \pi * \tan 15\circ} = 5.82$$

The cheese diameter $D_1$ for the next stage is determined as follows:

$$D_1=D_0+(D_0 \times F_D)=60+(60 \times 0.019)=61.140$$

The corresponding winding ratio $WD_1$ is determined as follows:

$$WD_1 = \frac{DH}{D_1 * \pi * \tan(\alpha_{SOLL}/2)} = \frac{294}{60 * \pi * \tan 15\circ} = 5.71$$

If, as the current cheese diameter $D_{akt}$ is ascertained continuously, the formula $$D_{akt} \leq D_1$$

is satisfied, then the cheese diameter $D_2$ and the corresponding winding ratio $WD_2$ are ascertained and converted into a corresponding traversing frequency of the yarn guide 13. In this way, the values listed in Table 2 are obtained.

TABLE 2

| D[mm] Bobbin Diameter | WD Winding Ratio | D[mm] Bobbin Diameter | WD Winding Ratio |
|---|---|---|---|
| 60.000 | 5.82 | 139.955 | 2.50 |
| 61.140 | 5.71 | 142.615 | 2.45 |
| 62.302 | 5.61 | 145.324 | 2.40 |
| 63.485 | 5.50 | 148.085 | 2.36 |
| 64.692 | 5.40 | 150.899 | 2.31 |
| 65.921 | 5.30 | 153.766 | 2.27 |
| 67.173 | 5.20 | 156.688 | 2.23 |
| 68.450 | 5.10 | 159.665 | 2.19 |
| 69.750 | 5.01 | 162.698 | 2.15 |
| 71.075 | 4.91 | 165.790 | 2.11 |
| 72.426 | 4.82 | 168.940 | 2.07 |
| 73.802 | 4.73 | 172.149 | 2.03 |

TABLE 2-continued

| D[mm] Bobbin Diameter | WD Winding Ratio | D[mm] Bobbin Diameter | WD Winding Ratio |
|---|---|---|---|
| 75.204 | 4.64 | 175.420 | 1.99 |
| 76.633 | 4.56 | 178.753 | 1.95 |
| 78.089 | 4.47 | 182.150 | 1.92 |
| 79.573 | 4.39 | 185.610 | 1.88 |
| 81.085 | 4.31 | 189.137 | 1.85 |
| 82.625 | 4.23 | 192.731 | 1.81 |
| 84.195 | 4.15 | 196.392 | 1.78 |
| 85.795 | 4.07 | 200.124 | 1.75 |
| 87.425 | 3.99 | 203.926 | 1.71 |
| 89.086 | 3.92 | 207.801 | 1.68 |
| 90.779 | 3.85 | 211.749 | 1.65 |
| 92.503 | 3.78 | 215.772 | 1.62 |
| 94.261 | 3.71 | 219.872 | 1.59 |
| 96.052 | 3.64 | 224.050 | 1.56 |
| 97.877 | 3.57 | 228.307 | 1.53 |
| 99.737 | 3.50 | 232.644 | 1.50 |
| 101.632 | 3.44 | 237.065 | 1.47 |
| 103.563 | 3.37 | 241.569 | 1.45 |
| 105.530 | 3.31 | 246.159 | 1.42 |
| 107.535 | 3.25 | 250.836 | 1.39 |
| 109.578 | 3.19 | 255.602 | 1.37 |
| 111.660 | 3.13 | 260.458 | 1.34 |
| 113.782 | 3.07 | 265.407 | 1.32 |
| 115.944 | 3.01 | 270.449 | 1.29 |
| 118.147 | 2.96 | 275.588 | 1.27 |
| 120.392 | 2.90 | 280.824 | 1.24 |
| 122.679 | 2.85 | 286.160 | 1.22 |
| 125.010 | 2.79 | 291.597 | 1.20 |
| 127.385 | 2.74 | 297.137 | 1.18 |
| 129.805 | 2.69 | 302.783 | 1.15 |
| 132.272 | 2.64 | 308.536 | 1.13 |
| 134.785 | 2.59 | 314.398 | 1.11 |
| 137.346 | 2.54 | 320.371 | 1.09 |

According to a further feature of the present invention, the graduation of the winding ratios in a core region of the cheese is increased yet again, by way of an additional multiplier $F_M$, for instance by the formula:

$$WD_{n+1}=WD_n-F_M \times (F_{ST} \times D_{WD})$$

wherein the multiplier $F_M$ is greater than 1.

Figure 4:
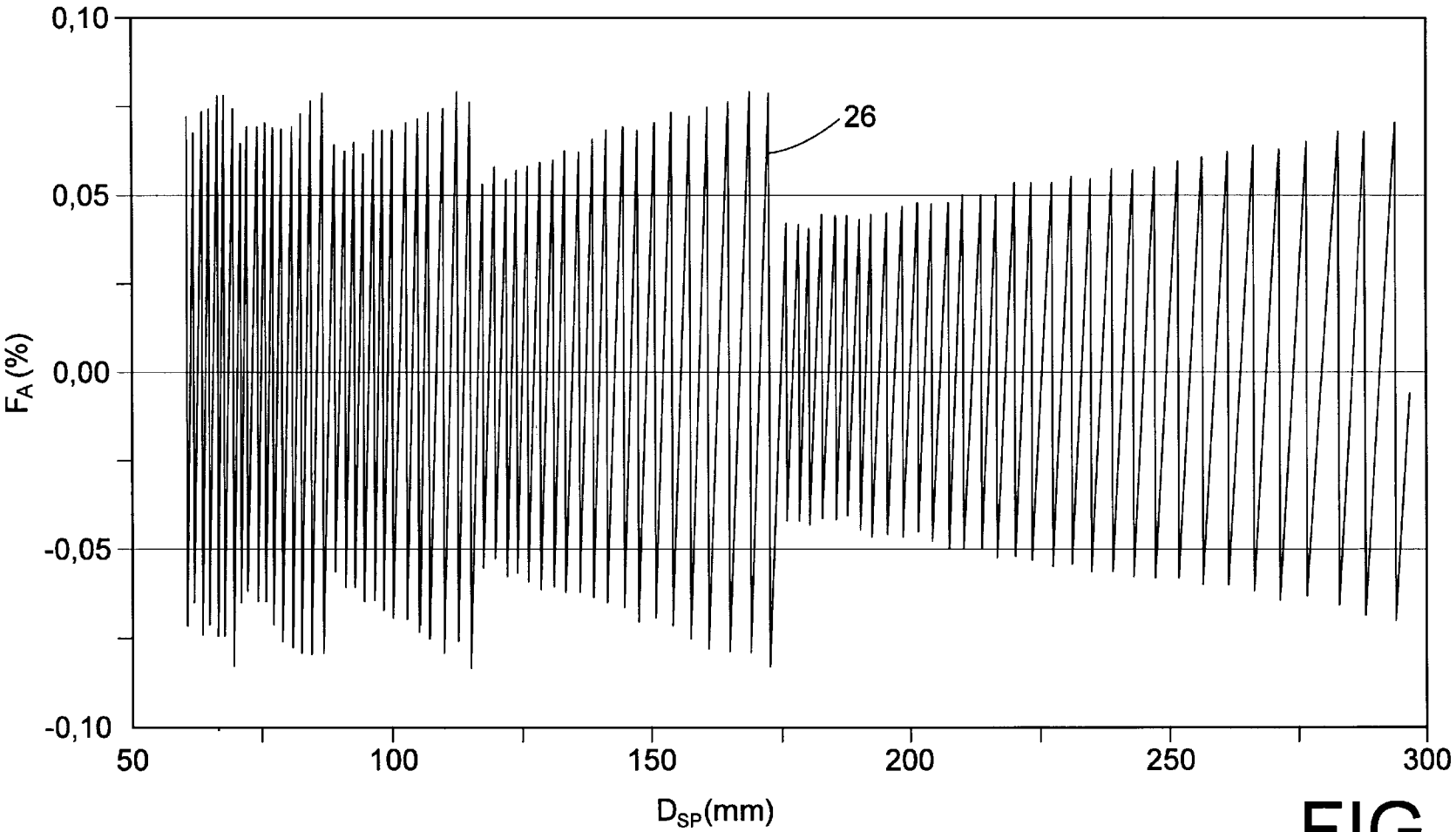
FIG. 4 depicts the progression of the error in the tension distortion in a winding operation according to the present invention.

According to the invention, the slight graduation of the winding ratios leads to minimal fluctuations in the crossing angle. For a graduation factor $F_{ST}$=0.025, the absolute error $F_A$ in the tension distortion varies within the tolerance range of ±0.1%, as FIG. 4 shows. The error $F_A$ is plotted over the cheese diameter D in the form of the curve 26.

In a further feature of the invention, the thusly-ascertained winding ratios $WD_n$ can be used merely to determine the switchover points. These winding ratios will hereinafter be called fundamental ratios. Depending on the applicable fundamental ratio, a certain number of yarn winding diamonds n is obtained. If the number of diamonds $n_R$ assumes lower values, such as 1, 2, 4, 5 or 8, then it can happen that the diamonds will not be filled completely or uniformly before a switchover to the next winding ratio is made.

In a further variant of the method of the present invention, a winding ratio supplement $i_z$ is added to the fundamental ratio (or alternatively is subtracted from it), e.g., by the formula:

$$WDV_n=WD_n+i_z, \text{ wherein}$$

$i_z$=winding ratio supplement

WDV=modified winding ratio.

The winding ratio supplement $i_z$ is ascertained from the following formula:

$$i_z = \frac{s}{n_R \cdot \pi \cdot D_{SP} \cdot \sin(\alpha/2)}$$

Wherein s=yarn spacing in mm $D_{SP}$=cheese diameter in mm $\alpha$=set-point crossing angle in degrees $n_R$=number of diamonds With the altered winding ratio WDV, the yarn winding diamonds can be closed or uniformly filled. The cheeses thus obtained are distinguished by an especially uniform high density, especially smooth flanks without bumps and bloomings at the bobbin edges, and very good unwinding (i.e., reeling off) properties. Table 3 shows a small representative selection of possible winding ratios with the associated number of diamonds.

TABLE 3

| WD Winding Ratio | n Number of Diamonds | WD Winding Ratio | n Number of Diamonds |
|---|---|---|---|
| 5.000 | 1 | 4.725 | 40 |
| 4.975 | 40 | 4.700 | 10 |
| 4.950 | 20 | 4.675 | 40 |
| 4.925 | 40 | 4.650 | 20 |
| 4.900 | 10 | 4.625 | 8 |
| 4.875 | 8 | 4.600 | 5 |
| 4.850 | 20 | 4.575 | 40 |
| 4.825 | 40 | 4.550 | 20 |
| 4.800 | 5 | 4.525 | 40 |
| 4.775 | 40 | 4.500 | 2 |
| 4.750 | 4 | | |

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. In an open-end spinning system, a method for graduated precision winding of a staple fiber yarn fed at a constant yarn speed onto a cheese rotating at constant circumferential speed, wherein the winding ratio during progressive building of the cheese is reduced in stages by graduations of decreasing size as the diameter of the cheese increases, each such graduation decreasing the winding ratio by a value not exceeding 0.3, and each such graduation decreasing the winding ratio being selected to be sufficiently small to produce a change in a crossing angle of the yarn during winding of between about ±0.8° of a predetermined set-point value for the crossing angle and selected to be sufficiently large to completely fill a smallest number of yarn winding diamonds occurring in the respective yarn winding stage.

2. The method of claim 1, characterized in that each graduation is selected to produce a change in the crossing angle of between about ±0.5° of the set- point value of the crossing angle.

3. The method of claim 1, characterized in that a graduation in a core region of the cheese is increased by a predetermined multiplier.

4. The method of claim 1, characterized in that each graduation is selected by calculating each successive winding ratio by subtracting from the then prevailing winding ratio an amount obtained by multiplying the integral component of the prevailing winding ratio by a graduation factor.

5. The method of claim 4, characterized in that the graduation factor is no greater than 0.05.

6. The method of claim 5, characterized in that the graduation factor is between 0.02 and 0.05.

7. The method of claim 1, characterized in that each graduation is selected by calculating each successive winding ratio by multiplying the then prevailing cheese diameter by a percentage factor, adding the resultant multiplication product to the prevailing cheese diameter, and converting the value of the resultant cheese diameter sum into a corresponding value for the successive winding ratio.

8. The method of claim 1, characterized in that each winding ratio is selected by adding to or subtracting from the prevailing winding ratio a supplemental step-up ratio derived from a quotient of a yarn spacing value and a number of diamonds for the prevailing winding ratio.

9. The method of claim 1, characterized in that each graduation is selected to obtain a successive winding ratio which will produce a desired known number of yarn winding diamonds.

10. The method of claim 9, characterized in that the number of yarn winding diamonds is no greater than 50.

* * * * *